US006142056A

United States Patent [19]

Taleyarkhan

[11] Patent Number: 6,142,056

[45] Date of Patent: Nov. 7, 2000

[54] VARIABLE THRUST CARTRIDGE

[75] Inventor: Rusi P. Taleyarkhan, Knoxville, Tenn.

[73] Assignee: U.T. Battelle, LLC, Oak Ridge, Tenn.

[21] Appl. No.: 09/057,127

[22] Filed: Apr. 8, 1998

Related U.S. Application Data

[63] Continuation-in-part of application No. 08/738,672, Oct. 28, 1996, abandoned, and a continuation-in-part of application No. 08/573,813, Dec. 18, 1995, Pat. No. 5,586,597.

[51] Int. Cl.[7] ..... F42B 12/56

[52] U.S. Cl. ..... 89/7; 42/84; 102/440

[58] Field of Search ..... 89/7; 102/443, 102/430, 439, 440; 42/84

[56] References Cited

U.S. PATENT DOCUMENTS

| | | | |
|---|---|---|---|
| 667,435 | 2/1901 | Friese-Greene et al. | 89/7 |
| 1,358,296 | 11/1920 | Csanyl | 89/7 |
| 2,995,987 | 8/1961 | Fitzpatrick | 89/7 |
| 3,494,249 | 2/1970 | Choate | 102/439 |
| 4,036,141 | 7/1977 | Korr et al. | 102/443 |
| 4,656,092 | 4/1987 | Haman et al. . | |
| 5,052,272 | 10/1991 | Lee . | |
| 5,072,647 | 12/1991 | Goldstein et al. | 102/440 |
| 5,355,764 | 10/1994 | Marinos et al. . | |
| 5,429,030 | 7/1995 | Tidman | 89/7 |
| 5,431,105 | 7/1995 | Wilkinson . | |
| 5,565,649 | 10/1996 | Tougeron et al. . | |
| 5,586,597 | 12/1996 | Taleyarkhan . | |
| 5,703,322 | 12/1997 | Tidman | 89/7 |

FOREIGN PATENT DOCUMENTS

| | | | |
|---|---|---|---|
| 37952 | 7/1909 | Austria . | |
| 220556 | 5/1987 | European Pat. Off. | 89/7 |
| 407581 | 12/1924 | Germany | 89/7 |
| 641900 | 7/1962 | Italy . | |
| 6101996 | 4/1994 | Japan | 102/430 |
| 6180199 | 6/1994 | Japan | 102/430 |
| 6241687 | 9/1994 | Japan | 89/7 |
| 2001378 | 10/1993 | Russian Federation . | |
| 2081427 | 2/1982 | United Kingdom . | |
| 2218495 | 11/1989 | United Kingdom | 102/430 |
| 2241563 | 9/1991 | United Kingdom | 102/430 |

OTHER PUBLICATIONS

Long, George, "Explosions of Molten Aluminum in Water—Cause and Prevention," *Metal Progress*, May 1957, p. 107–112.

*Primary Examiner*—Stephen M. Johnson
*Attorney, Agent, or Firm*—Kirk A. Wilson

[57] ABSTRACT

The present invention is a variable thrust cartridge comprising a water-molten aluminum reaction chamber from which a slug is propelled. The cartridge comprises a firing system that initiates a controlled explosion from the reaction chamber. The explosive force provides a thrust to a slug, preferably contained within the cartridge.

8 Claims, 5 Drawing Sheets

VARIABLE THRUST CARTRIDGE

CROSS-REFERENCE TO RELATED APPLICATIONS

This application is a continuation-in-part of an earlier filed U.S. patent application Ser. No. 08/738,672, filed on Oct. 28, 1996, now abandoned, and U.S. patent application Ser. No. 08/573,813, filed Dec. 18, 1995, and issued on Dec. 24, 1996 as U.S. Pat. No. 5,586,597, herein incorporated in their entirety by reference.

This United States Government has rights in this invention pursuant to contract DE-AC05-84OR21400 between the United States Department of Energy and Lockheed Martin Energy Systems, Inc., and also pursuant to contract DE-AC05-960R22464 between the United States Department of Energy and Lockheed Martin Energy Research Corporation.

FIELD OF THE INVENTION

The present invention relates to a variable thrust generator, and more particularly to a selectably variable thrust cartridge that can be fired without lethal impact.

BACKGROUND OF THE INVENTION

The development of non-lethal projectiles for firearms in recent times for use in violent and criminal situations has been addressed primarily with the design and material of a soft slug in order to soften the impact of the slug to a non-lethal level. Soft slugs such as "rubber bullets" have long been used with conventional thrust systems of chemically-reactive powders and substances to create a cartridge for use in conventional guns, especially small arms such as rifles, shotguns, pistols and revolvers. The use of such propellants have several disadvantages including toxic chemical fumes, loud report, large shock waves, and a non-variable thrust which cannot be modified to meet the need for non-deadly use at close ranges or with smaller targets. The current conventional non-lethal bullets are made of some soft material such as rubber, plastic or foam. Other non-lethal projectiles or slugs have been described as bean-bags, sand-bags, foam bullets and the like. But even these projectiles can be deadly at close range and with smaller human targets. A slug for which the velocity and thus the impact can be modified to match a variety of desired non-lethal applications has long been needed. The present invention addresses the problem from the standpoint of the propulsive system itself and not the slug or projectile, thereby meeting this need by providing a variably and selectably controlled propulsive system.

OBJECTS OF THE INVENTION

Accordingly, it is an object of the present invention to provide a novel variable thrust cartridge.

In addition, it is an object to utilize the water-molten material, such as aluminum, explosion phenomenon to achieve thrust variability.

It is another object to provide a variable thrust cartridge that eliminates the characteristic shock waves and toxic chemical fumes of conventional chemical-reactive explosions.

It is yet a further object of the present invention to provide a variable thrust cartridge that has a controllable explosion.

It is still a further object of the present invention to provide a variable thrust cartridge for which the desired thrust can be determined immediately at the time of use by visual or other data feedback techniques.

It is a further object of the present invention to provide a variable thrust cartridge that can use a variety of slugs comprising fluids, rubber, plastic, foam, an assembly such as a "bean-bag" containing lightweight, soft, resilient, or granular material, and an "air-bag" assembly safety device.

It is a further object of the present invention to provide a variable thrust cartridge that eliminates many of the disadvantages of a chemical detonation.

Further and other objects of the present invention will become apparent from the description contained herein.

SUMMARY OF THE INVENTION

In accordance with one aspect of the present invention, the foregoing and other objects are achieved by a variable thrust cartridge which comprises a substantially rigid casing, the inside dimension of which generally defines an extension to the inside surface of the bore of a barrel in which the cartridge is used, and which encloses a projectile; a reaction chamber containing a vaporizing mixture such as water; a partition which separates said slug and said reaction chamber; said partition configured and disposed to perform as a piston within said casing and the inside dimension of the bore of the barrel; a pellet bank comprising at least one propellant pellet, said propellant pellet further comprising at least one high energy material contained within said vaporizing mixture-filled reaction chamber; and a means for firing said pellet bank disposed and connected to fire any predetermined number of pellets in said pellet bank, whereby said fired predetermined number of pellets produce heat to vaporize said vaporizing mixture into pressurized vapor, the expanded vapor pressure thereby driving said projectile from the casing, through the bore of the barrel, and toward an intended target at a desired velocity.

DETAILED DESCRIPTION OF THE INVENTION

Figure 1:
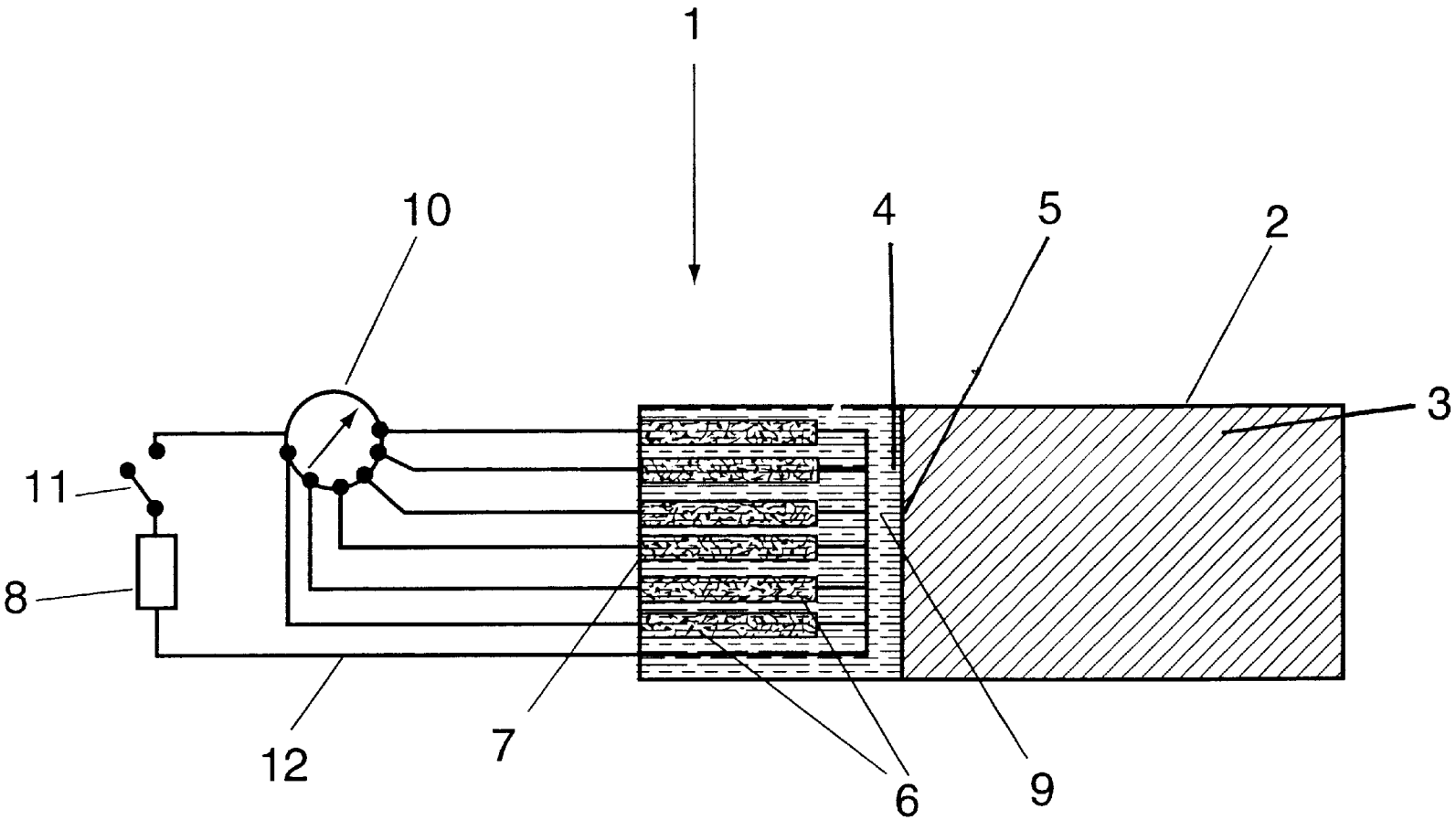
FIG. 1 is a cutaway view of a cartridge embodiment of the present invention.

FIG. 1 shows a cutaway view of one embodiment of a variable thrust cartridge 1 in accordance with the present invention. A substantially rigid casing 2 contains a plurality of parts of the cartridge 1. The casing 2 is preferably made of a solid material such as metal or plastic. The casing 2 is usually cylindrical in shape and is made to a diameter that fits the housing of the particular barrel in which it is used. The length of the casing 2 also is made to fit the barrel in which it is used. Other design parameters of the casing, such as the thickness and surface texture, can be modified to fit as needed. The slug 3 may comprise a fluid; a soft, solid substance such as rubber, plastic, or foam; an assembly such as a "bean-bag" containing lightweight, soft, resilient, or granular material; and an "air-bag" assembly safety device. The design parameters of the slug 3, such as hardness, size, weight, and shape, can be modified to fit a variety of applications. The slug 3 is the part of the cartridge 1 that can be propelled from a preferred embodiment gun, shown in FIG. 6*a*. The casing 2 at one end encases the slug 3. The slug 3 lies in front of partition 5 and a reaction chamber 4 that provides thrust. Partition 5 may preferably be a movable partition or piston, functioning in the same manner as an over-powder wad in conventional shotgun ammunition. Partition 5 may also provide sealing means to seal between the partition and the barrel bore, and may further provide cushioning between the propellant gas/steam pressure and the projectile.

The reaction chamber 4 provides a variable, controlled thrust to the slug 3, utilizing a molten material-vaporizing mixture explosion, such as an aluminum-water explosion. The reaction chamber 4 contains a vaporizing mixture 9 such as water and preferably an aluminum pellet bank 6 wherein the pellet bank 6 comprises a plurality of pellets individually disposed and connected to the firing means 8 to incrementally fire at least one of said pellets. The aluminum pellet bank 6 preferably contains a mixture, such as thermite or aluminum-perchlorate, although different design variations of placing and forming the mixture in and around the aluminum pellet bank 6 may be used. The aluminum pellet bank 6 reacts with vaporizing mixture 9 either with or without a chemical reaction. Without a chemical reaction, only high-pressure steam is produced along with quenched material. The vapor is used for thrust. If chemical reactions do occur, they occur on a very fast, explosive time scale, producing both high-pressure steam and aluminum oxide and hydrogen gas, thereby increasing the pressure and intensifying the thrust. The aluminum pellet bank 6 extends from the rear 7 of the chamber 4 for connection to a firing means 8 selected from at least one of the group comprising at least one battery, at least one capacitor, at least one piezoelectric device, and at least one operational amplifier. The aluminum pellet bank 6 preferably contains a plurality of aluminum pellets, the size, location and number of which are modifiable to provide the amount of thrust desired.

The vapor explosion occurs when the vaporizing mixture 9 is rapidly vaporized to steam. The molten-metal state occurs when a stimulus, such as an electrical charge, is initiated by the firing means 8 to result in either direct melting of the metal from electrical energy or melting of the metal due to chemical heat released from the pellet mixture. This firing means 8 may be selected from the group comprising at least one battery, at least one capacitor, at least one piezoelectric device, and at least one operational amplifier. The firing means need only produce an electrical impulse on the order of 10 joules of energy to initiate the explosion; therefore a small battery or a device similar to a camera flash unit is sufficient. The firing means 8 need not be large or cumbersome and may be designed into the cartridge 1 adjacent to the reaction chamber 4. A trigger switch 11 can initiate flow of current in said firing means 8.

A selector switch 10 may act as the control for the initiation of the explosion and provides means to select the amount of thrust desired. The selector switch 10 may be integrated into the design of the firing means 8. The selector switch 10 routes electric current to a predetermined number of pellets in pellet bank 6 and routes electric current to an incrementally cumulative number of pellets to be fired thereby determining the amount of thrust generated in the reaction chamber 4 and the resulting velocity of the projectile. The selector switch 10 may be a rotary type switch that is progressively shorting thereby connecting consecutive switch positions to the common 12 such that in position 1, terminal 1 is connected to the common 12; in position 2, terminals 1 and 2 are connected to the common 12; and so on.

Figure 2:
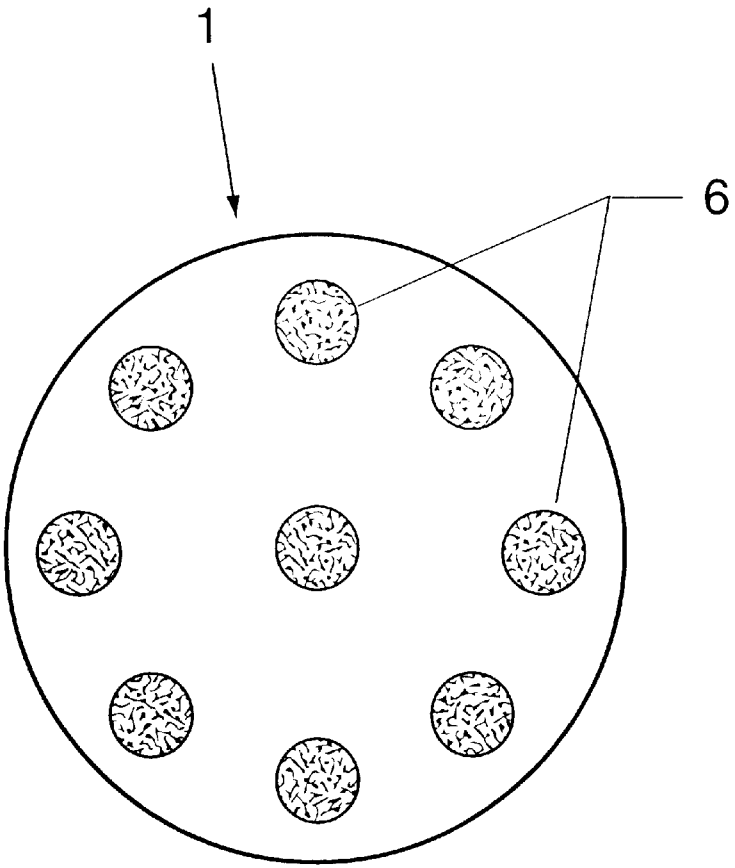
FIG. 2 is an end view of a cartridge embodiment of the present invention.

FIG. 2 is an end view of the cartridge 1 showing a circular pattern arrangement of pellets in the pellet bank 6.

Figure 3:
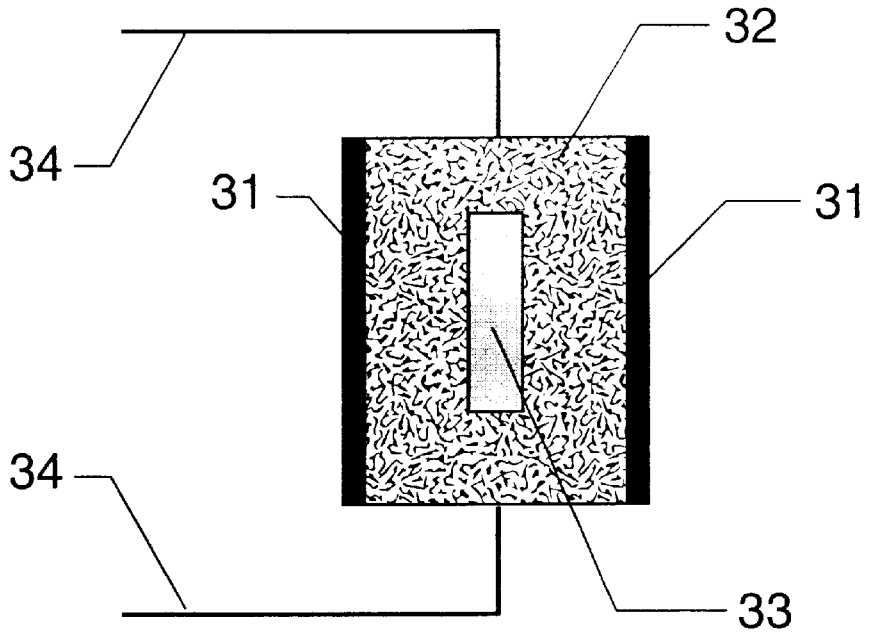
FIG. 3 is a section cut of a single pellet representative of a cartridge embodiment in accordance with present invention.

FIG. 3 is a sectional view of a single pellet representative of the pellet bank 6. The pellet comprises a mass of wrap material 31, such as aluminum, wrapped around a booster charge 32, such as thermite or aluminum-perchlorate, that contains a vaporizing mixture 33, such as water, a water-in-jell mixture, water with aluminum powder laced with potassium perchlorate, or a conventional primer, such as percussion caps, for igniting and/or dispersing the molten material resulting from combustion of the pellet into surrounding water. Varying the relative amounts of the various materials in the booster charge 32 controls the amount of steam pressure that results from the reaction of chemical components produced during explosion. Electrical leads 34 are routed from one end of the pellet to cartridge contacts on the rear of the cartridge and from the other end of the pellet to a common 12 thereby completing the electrical circuit to be initiated by the trigger switch 11. The cartridge casing 2 can act as a common 12 for completing the circuit.

Figure 4:
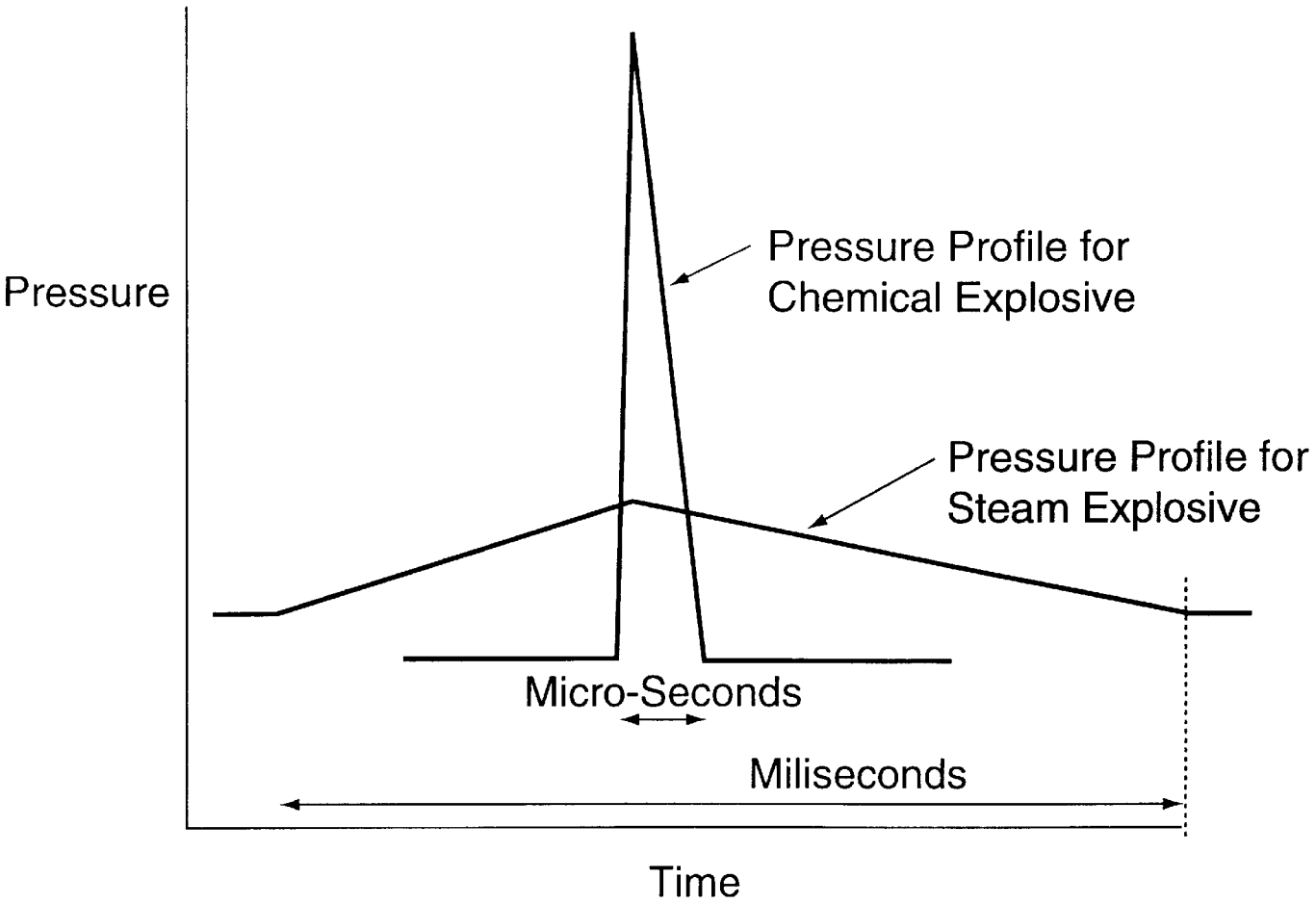
FIG. 4 is a graph comparing pressure profiles over time of a chemical detonation such as that of a powder-charged gun cartridge and a vapor explosion of a cartridge in accordance with the present invention.

The cartridge is preferably cylindrically-shaped to fit conventional guns. The thrust generated by the cartridge is produced by the contact of molten material, preferably aluminum, and other products resulting from firing the pellet, with water. This phenomenon is well known by the skilled artisan. As shown in FIG. 4, the molten material-vaporizing mixture, such as aluminum-water, explosion reaction creates extremely high pressures in milliseconds through the near-instantaneous conversion of the vaporizing mixture to vapor because of the rapid heat transfer that takes place from the hot melt to the mixture. The controlling factors for the amount of pressure are the melt temperature, the amount of melt and the amount, temperature, surface area and depth of the vaporizing mixture. All these parameters can be controlled; therefore, the explosive force can be controlled to produce a broad range of vapor pressures, and thus a broad range of projectile velocities, pressure or shock waves, and noise. The extent of the aluminum-water vapor explosion can be several orders of magnitude longer than a typical chemical explosive detonation. FIG. 4 is a plot showing time versus pressure, which outlines this effect. This variable force over an extended period of several milli-seconds, minimizes the mechanical energy dissipation from shock waves and is a key to the concept of the variable thrust cartridge. In comparison to conventional ammunition, the molten aluminum-water explosion process can produce larger amounts of mechanical work because minimal amounts of energy are dissipated in the shock wave compared to a typical gun propellant's chemical explosion. The thermal-to-mechanical energy conversion efficiency can be very high, in the order of 35%–55%.

Figure 5:
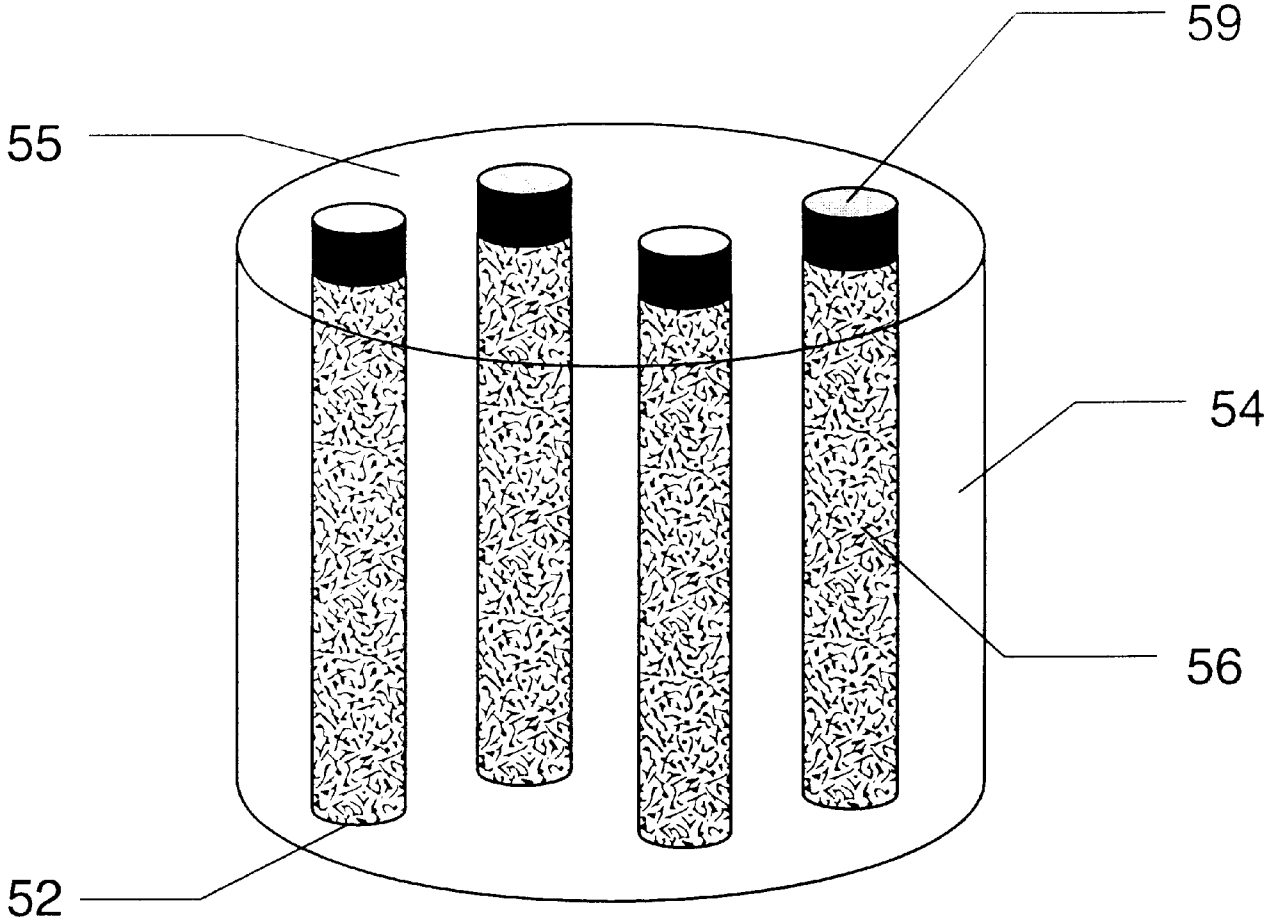
FIG. 5 is a perspective view of a second cartridge embodiment of the present invention.

FIG. 5 is a second embodiment of the reaction chamber 54 of the present invention wherein the reaction chamber 54 is a solid plug defining at least one hole therethrough, each hole at least partially filled with high energy material, such as a blend of booster charge and vaporizing mixture, to form a pellet or pellets 56. Cartridge contacts 52 are disposed in the rear of the pellets 56 to enable electrical current to flow through a firing means and selector switch when a trigger switch is closed. Disposed between the partition 55 and the pellet 56 is wadding 59 comprising felt or plastic materials.

Figure 6A:
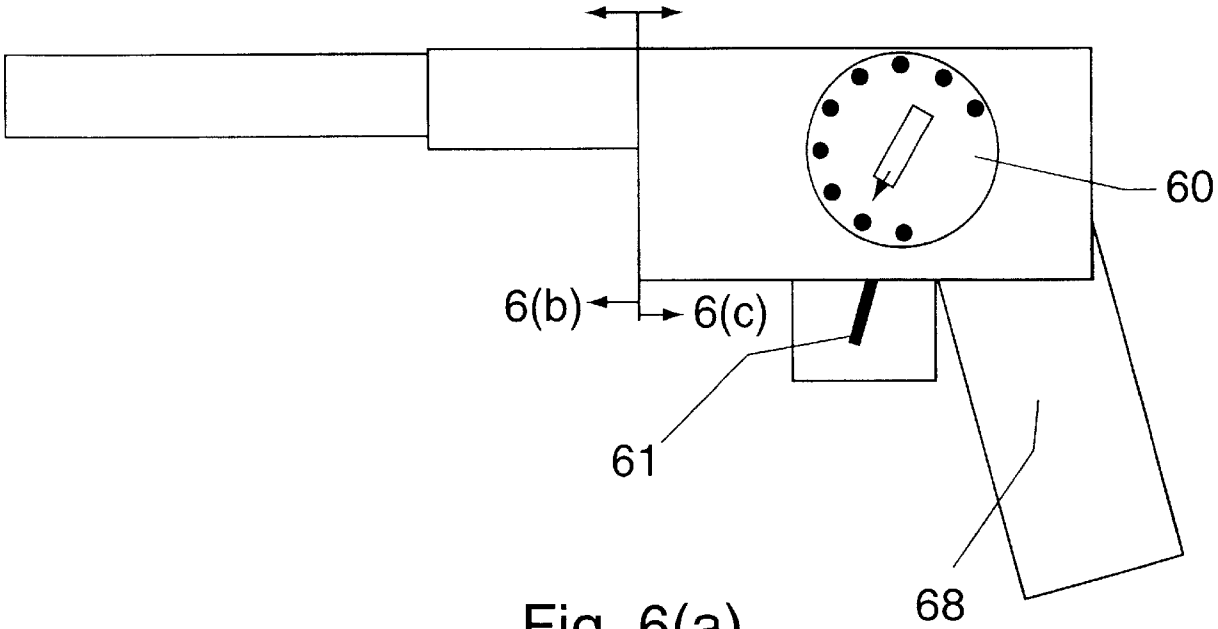
FIG.6*a* is a side view of a handgun embodiment of the present invention.
Figure 6C:
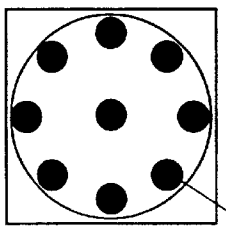
FIGS. 6*b* and 6*c* show cartridge and barrel contacts.
Figure 6B:
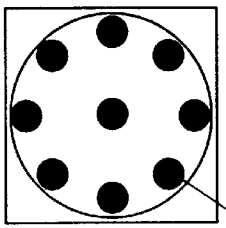

FIG. 6*a* shows the present invention embodied into a rifle, shotgun, or handgun-type device. A firing means 68, a trigger switch 61, and a selector switch 60 send the desired current through the high energy material pellets, such as aluminum pellets, and melt these pellets at a desired temperature. The cartridge is loaded such that the cartridge contacts 62 mate with the barrel contacts 63, as shown in FIGS. 6*b* and 6*c*, thereby completing the electrical circuit. Each barrel contact 63 is individually connected to a single terminal of the selector switch allowing the selector switch to route electric current to an incrementally cumulative number of pellets to be fired.

The pellets may further comprise other high-energy materials, such as aluminum, magnesium, thermite, aluminum powder laced with potassium perchlorate, and potassium nitrate, to assist the ignition of the pellets. All the desired variable factors and parameters can be controlled. Table 1 below is a table showing the findings and comparisons of seven different controllable parameters calculated during tests of this concept.

TABLE 1

| Slug Mass (kg) | Velocity (m/s) | Kinetic Energy (J) | Thermal Energy (J) | Electrical Energy (J) | Mass of Aluminum Wire (kg) | Water Volume (cc) |
|---|---|---|---|---|---|---|
| 0.001 | 10 | 0.05 | 0.2 | 0.02 | 1.1E − 08 | 0.003 |
| 0.001 | 100 | 5 | 20 | 1.67 | 1.1E − 06 | 3.11 |
| 0.01 | 10 | 0.5 | 2 | 0.17 | 1.1E − 07 | 0.31 |
| 0.01 | 100 | 50 | 200 | 16.67 | 1.1E − 05 | 31.11 |
| 0.1 | 10 | 5 | 20 | 1.67 | 1.1E − 06 | 3.11 |
| 0.1 | 100 | 500 | 2000 | 166.67 | 1.1E − 04 | 311.11 |
| 1 | 10 | 50 | 200 | 16.67 | 1.1E − 05 | 31.11 |
| 1 | 50 | 1250 | 5000 | 416.67 | 2.8E − 04 | 777.78 |

What is claimed is:

1. A variable thrust cartridge, comprising:

a. a substantially rigid casing;

b. a slug encased by said casing;

c. a reaction chamber comprising a vaporizing mixture, said chamber encased by said casing;

d. a partition disposed between said slug and said reaction chamber, said partition encased by said casing;

e. a pellet bank comprising at least one pellet, said pellet further comprising high energy material disposed in said reaction chamber;

f. a means for firing said pellet bank comprising;

a firing means selected from at least one of the group consisting of at least one battery, at least one capacitor, at least one piezoelectric device, and at least one operational amplifier;

at least one trigger switch for initiating flow of electric current;

at least one selector switch for routing said electric current to a selectable number of pellets in said pellet bank wherein said selector switch routes said electric current to an incrementally cumulative number of pellets to be fired;

contacts comprising at least one cartridge contact and at least one barrel contact disposed for enabling electrical contact between said cartridge and said barrel; and interconnecting electrical wiring between said firing means, said selector switch, said trigger switch, and said contacts;

wherein said cartridge is non-lethal.

2. A variable thrust cartridge as recited in claim 1, wherein said high energy material is at least one of the group consisting of aluminum, magnesium, thermite, aluminum powder laced with potassium perchlorate, and potassium nitrate.

3. A variable thrust cartridge as recited in claim 1, wherein said casing is cylindrical and comprises a plastic material.

4. A variable thrust cartridge as recited in claim 1, wherein said casing is cylindrical and comprises a material selected from the group consisting of metals and metal alloys.

5. A variable thrust cartridge as recited in claim 1, wherein said means for firing said pellet bank is disposed in said reaction chamber.

6. A variable thrust cartridge as recited in claim 1, wherein said pellet bank comprises a plurality of pellets.

7. A variable thrust cartridge as recited in claim 1, wherein said slug is selected from the group consisting of fluids, rubber, plastic, foam, a bean-bag assembly, and an air-bag assembly.

8. A variable thrust cartridge as recited in claim 2, wherein said vaporizing mixture is selected from at least one of the group consisting of water, and water with aluminum powder laced with potassium perchlorate.

* * * * *